US008367990B2

(12) United States Patent
Miller et al.

(10) Patent No.: US 8,367,990 B2
(45) Date of Patent: Feb. 5, 2013

(54) MODULAR COMMERCIAL MICROWAVE OVEN

(75) Inventors: Thomas Miller, Kalona, IA (US); Robert A. Schulte, Williamsburg, IA (US); Kami Poppen, West Branch, IA (US); Deborah Parenza, Des Moines, IA (US)

(73) Assignee: ACP, Inc., Cedar Rapids, IA (US)

( * ) Notice: Subject to any disclaimer, the term of this patent is extended or adjusted under 35 U.S.C. 154(b) by 449 days.

(21) Appl. No.: 12/783,938

(22) Filed: May 20, 2010

(65) Prior Publication Data

US 2010/0294754 A1 Nov. 25, 2010

Related U.S. Application Data

(60) Provisional application No. 61/179,987, filed on May 20, 2009.

(51) Int. Cl.
*H05B 6/80* (2006.01)

(52) U.S. Cl. ..... 219/756; 392/478; 392/520; 392/537

(58) Field of Classification Search ..... 219/756; 392/478, 520, 537; D7/348
See application file for complete search history.

(56) References Cited

U.S. PATENT DOCUMENTS

| | | | | |
|---|---|---|---|---|
| 3,777,118 | A * | 12/1973 | Creus | 219/394 |
| 4,699,119 | A * | 10/1987 | Benko et al. | 126/20 |
| 2007/0251519 | A1 * | 11/2007 | Anikhindi et al. | 126/194 |
| 2010/0095944 | A1 * | 4/2010 | Frock et al. | 126/20.1 |

* cited by examiner

*Primary Examiner* — Tom Thomas
*Assistant Examiner* — Christopher M Roland
(74) *Attorney, Agent, or Firm* — Diederiks & Whitelaw, PLC

(57) ABSTRACT

A microwave oven cabinet is ergonomic designed to provide for both stacking and jigsaw-type back-to-back interlining of multiple units of the microwave ovens. In particular, the cabinet configuration advantageously establishes a reduced footprint, ergonomically designed microwave oven which can be effectively employed in various fields, including fast food chains wherein multiple such ovens may need to be functionally positioned in a limited area, while still being easily accessible.

17 Claims, 4 Drawing Sheets

MODULAR COMMERCIAL MICROWAVE OVEN

CROSS-REFERENCE TO RELATED APPLICATIONS

The present application claims the benefit of U.S. Provisional Patent Application Ser. No. 61/179,987 entitled "Ergonomic Commercial Microwave Oven" filed May 20, 2009.

BACKGROUND OF THE INVENTION

1. Field of the Invention

The present invention pertains to the art of microwave ovens and, more particularly, to a reduced footprint, ergonomically configured microwave oven.

2. Discussion of the Prior Art

Basically, since its introduction as a commonplace cooking appliance, microwave ovens have taken a mainly box-like configuration, including a door which pivots about a vertical axis to access a cooking cavity which receives microwaves produced by a magnetron. Even commercial microwave ovens are commonly found with generally box-like designs. In general, these designs function extremely well under most circumstances. However, in certain fields such as fast food chains, space and oven cavity access are of particular concern and common microwave ovens fail to adequately address these concerns.

To this end, it would be beneficial to provide a reduced footprint, ergonomically designed microwave oven which could be effectively employed in various fields, including fast food chains wherein multiple such ovens may need to be functionally positioned in a limited area, while still being easily accessible.

SUMMARY OF THE INVENTION

The present invention provides an ergonomic design of a microwave oven cabinet which provides for stacking and jigsaw-type back-to-back interfitting of multiple ones of the microwave ovens. In particular, the invention provides a reduced footprint, ergonomically designed microwave oven which can be effectively employed in various fields, including fast food chains wherein multiple such ovens may need to be functionally positioned in a limited area, while still being easily accessible. Additional objects, features and advantages of the invention will become more readily apparent from the following detailed description of a preferred embodiment when taken in conjunction with the drawings wherein like reference numerals refer to corresponding parts in the several views.

DETAILED DESCRIPTION OF THE INVENTION

Figure 1:
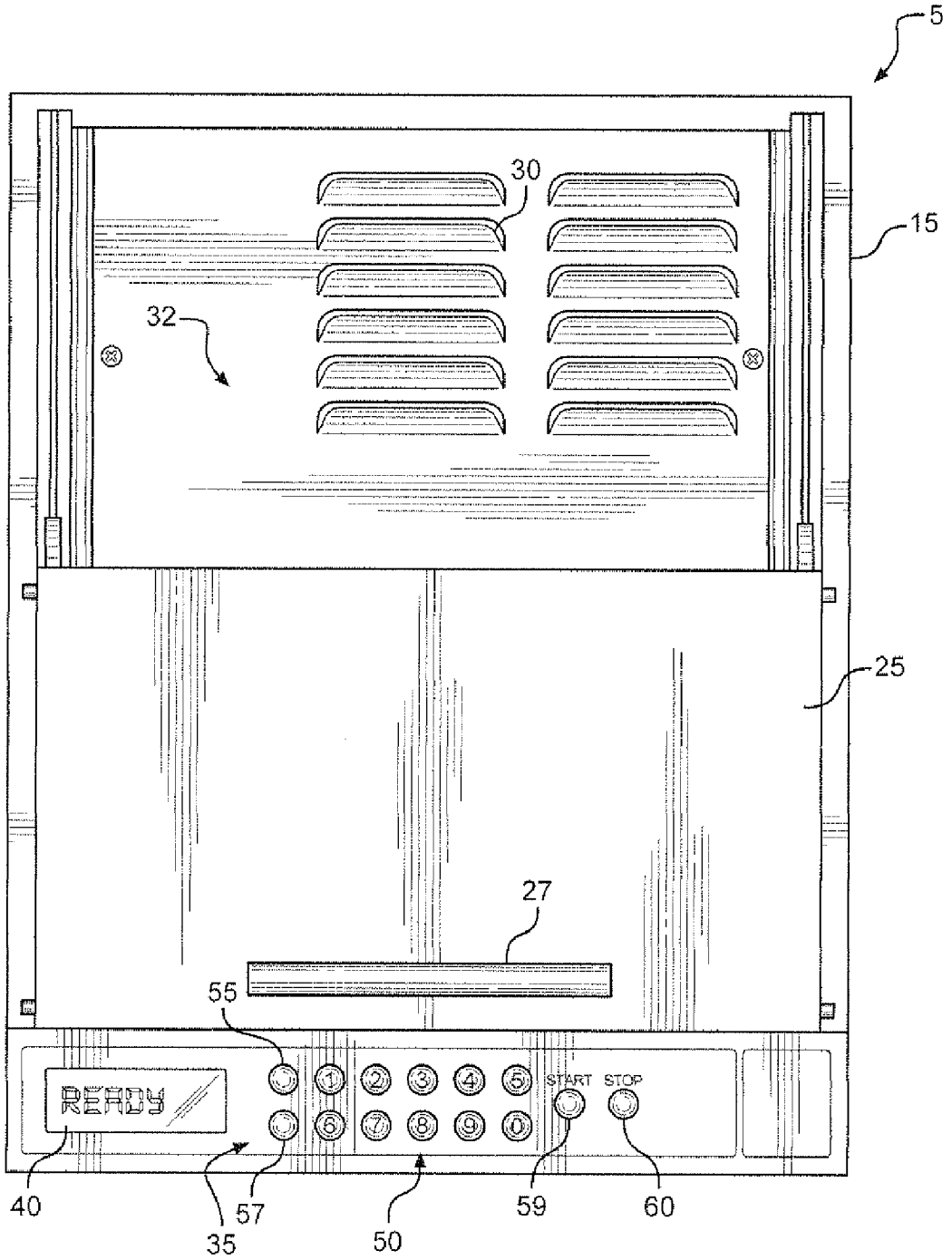
FIG. 1 is a front elevational view of a microwave oven of the invention, with a door shown in an opened position.
Figure 2:
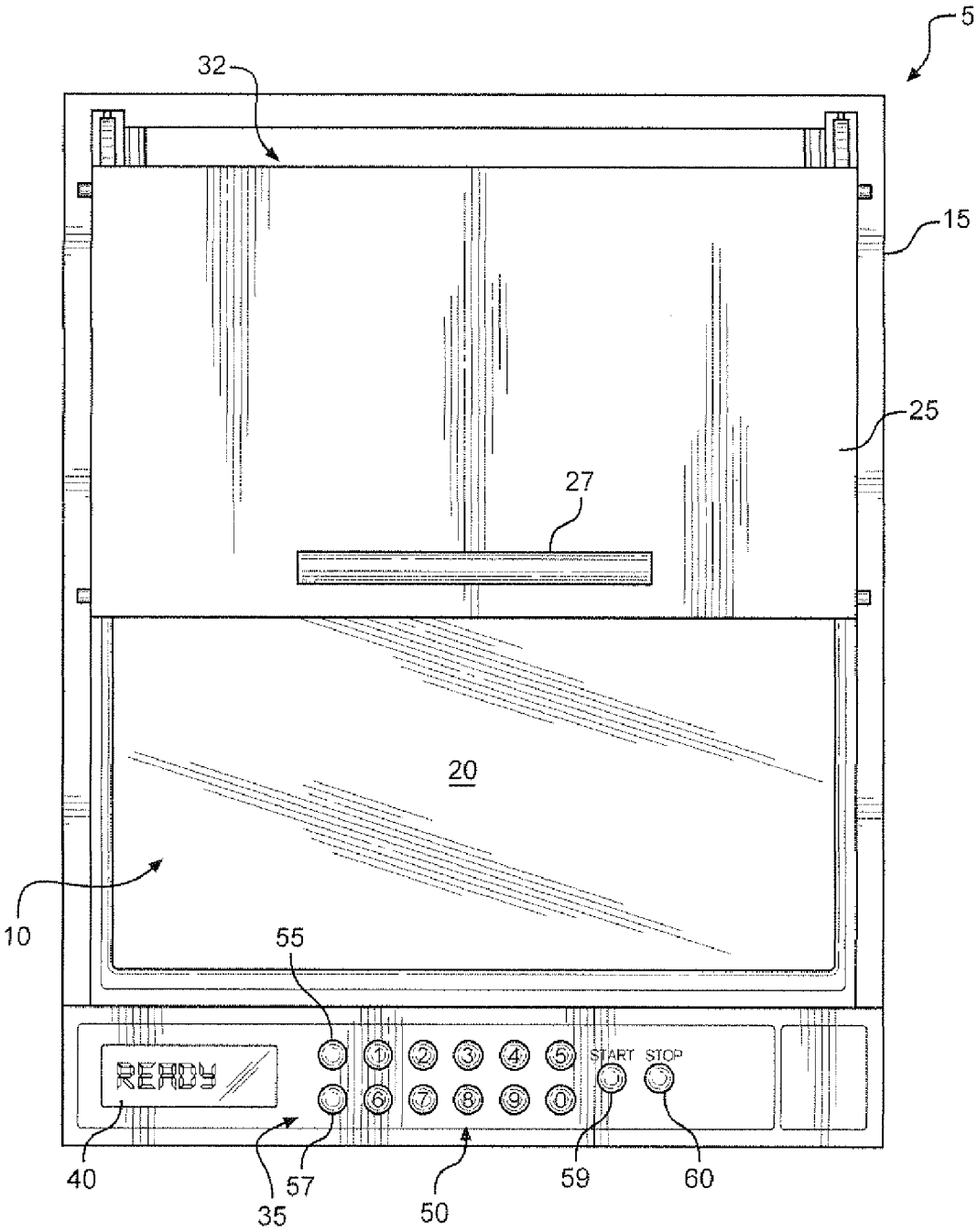
FIG. 2 is a front elevational view of the microwave, with the door shown in a closed position.

With initial reference to FIGS. 1 and 2, a microwave oven constructed in accordance with the present invention is generally indicated at 5. As shown, microwave oven 5 includes an outer cabinet 15 within which is formed a lower oven or process cavity 10 defined, at least in part, by a rear wall 20 arranged behind a door 25 having a handle 27. Door 25 is vertically, slidably movable between a closed position as shown in FIG. 1 wherein venting louvers 30 in an upper component housing portion 32 are exposed and an open position exposing cavity 10, while extending across and covering venting louvers 30, as shown in FIG. 2. In the embodiment shown, arranged below cavity 10 on a front portion of microwave oven 5 is a control panel 35 including a multi-segment display 40, a numeric keypad section 50, an entry button 55, a power level button 57, a start button 59 and a stop button 60. In the embodiment shown, cavity 10 is in the order of 13 inches (approx. 33 cm) wide, 8 inches (approx. 20 cm) deep and 6 inches (approx. 15 cm) in height. However, at this point, it should be noted that the particular construction, size and control panel configuration shown in these figures are only presented for exemplary purposes and can vary greatly in accordance with the overall invention. Although not shown, microwave oven 5 includes one or more magnetrons for generating microwaves which are directed into oven cavity 10 during a cooking operation. With this basic arrangement in mind, the present invention is particularly directed to the advantageous, ergonomic design of cabinet 15 which provides for stacking and jigsaw-type back-to-back interfitting arrangement for multiple microwave ovens 5.

Figure 3:
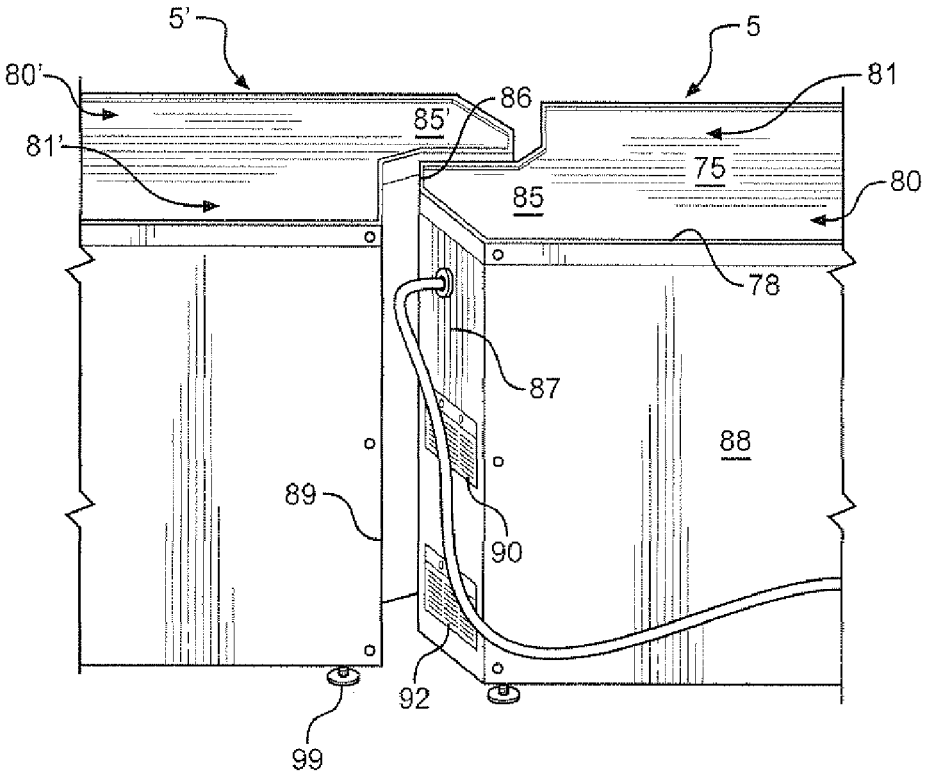
FIG. 3 is a perspective side view of two intermeshed microwave ovens constructed in accordance with the invention.
Figure 4:
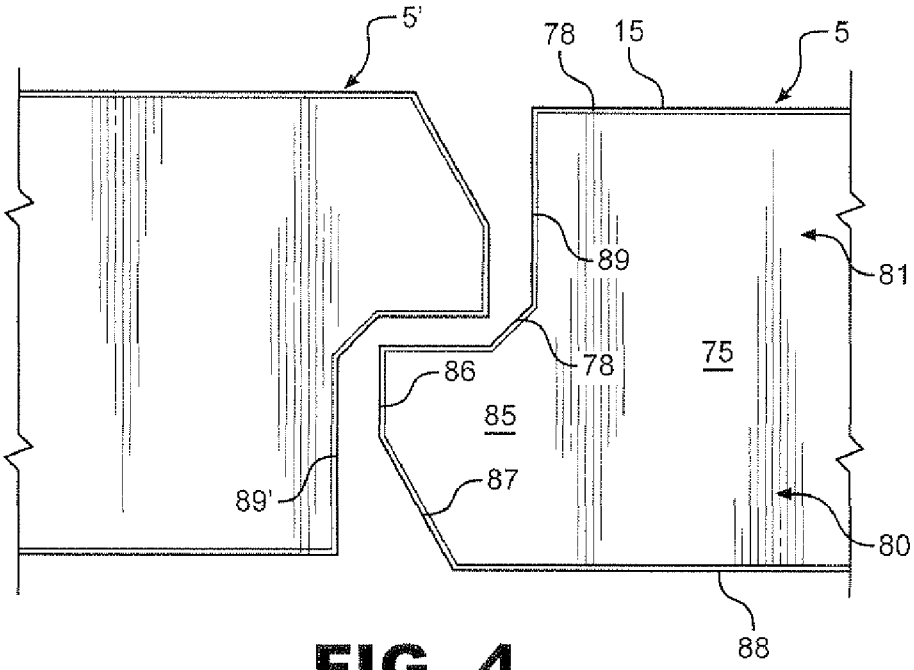
FIG. 4 is a top view of the intermeshed microwave ovens of FIG. 3.

With reference to FIGS. 3 and 4, a pair of microwave ovens 5, 5' constructed in accordance with the invention are shown arranged back-to-back. As shown, cabinet 15 of each microwave oven 5, 5' includes a top panel 75 having a raised peripheral edge 78. Each cabinet 15 is defined by a first or left lateral side portion 80, 80' and a second or right lateral side portion 81. As clearly illustrated, first lateral side portion 80 has a greater depth or fore-to-aft dimension as compared to second lateral side portion 81 such that first lateral side portion 80 defines an extension indicated at 85, with the rear of extension 85 including a first section 86 and an angled section 87 leading to a side wall 88 of cabinet 15. In a back wall 89 of cabinet 15, specifically along angled section 87, is provided vents 90, 92. When microwave ovens 5, 5' are arranged back-to-back, the extension 85 of microwave oven 5 is arranged adjacent second lateral side portion 81' of microwave oven 5', and the extension 85' of microwave oven 5' is arranged adjacent second lateral side portion 81 of microwave oven 5 in order to provide a compact, interfitting or intermeshed arrangement. With the inclusion of angled sections 87, there is ample spacing at this location between angled section 87 and back wall 89' to provide for suitable ventilation.

In addition to meshing back-to-back, microwave ovens 5, 5' can be conveniently stacked. Although the stacking arrangement can be carried out in various fashions without departing from the invention, each of microwave ovens 5, 5' is shown to be supported by one or more, preferably vertically adjustable, spaced feet, one of which is indicated at 99. When microwave ovens 5, 5' are stacked, as further discussed and shown in connection with FIG. 5, the various feet 99 are arranged adjacent respective portions of the raised peripheral edge 78, thereby relatively locating the stacked ovens 5, 5' in relation to each other.

Figure 5:
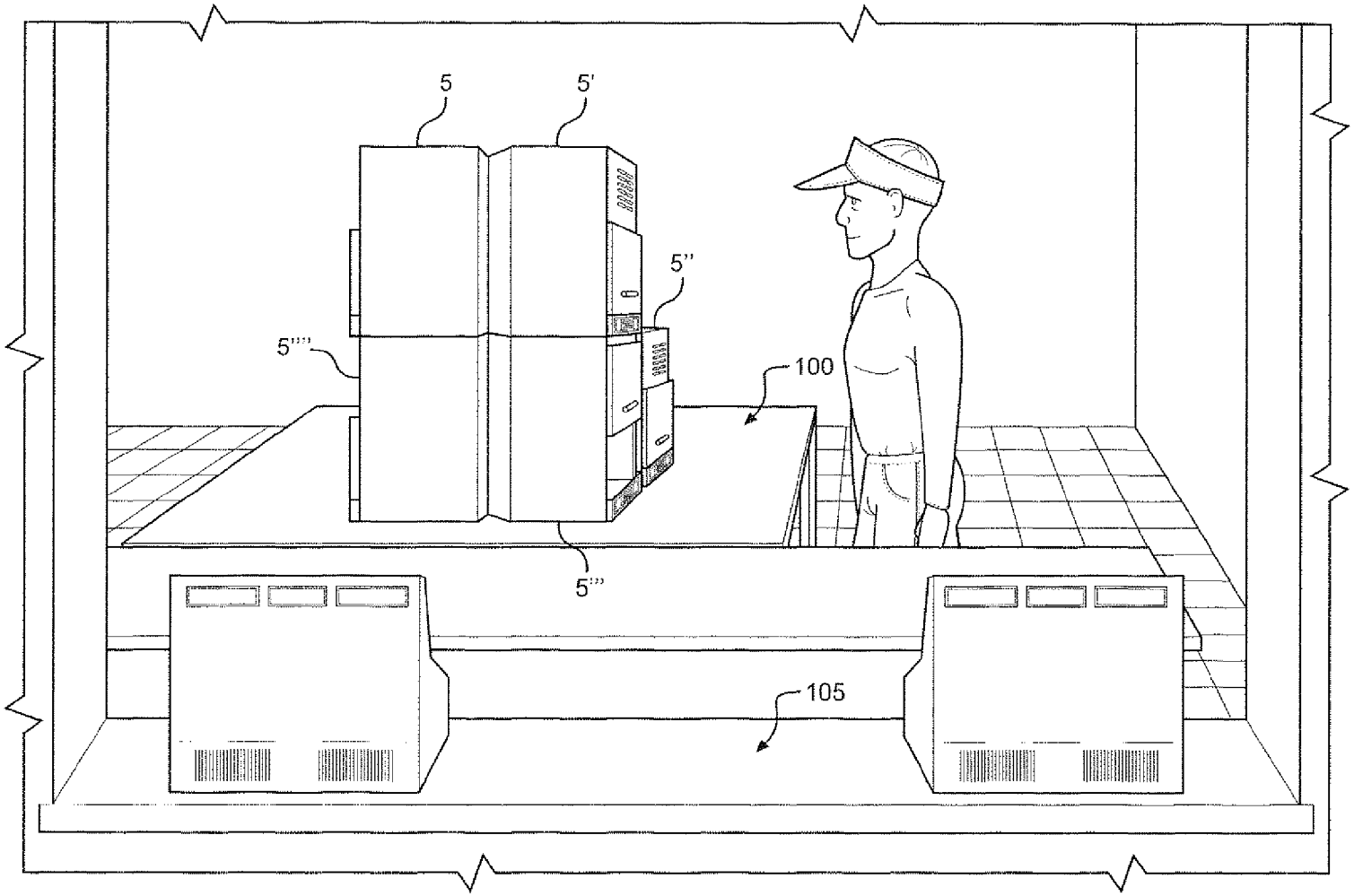
FIG. 5 illustrates an interior portion of a commercial fast food chain employing multiple back-to-back and even stacked microwave ovens constructed in accordance with the invention.

Based on the above, it should be readily apparent that the invention establishes an ergonomic design for cabinet 15 which provides for both stacking and jigsaw-type back-to-back interfitting of multiple microwave ovens 5, 5'. This arrangement is seen to be particularly advantageous in connection with utilizing various sets of ovens 5, 5' in commercial fast food chains where space is limited and extremely convenient access to the ovens 5, 5' is needed for efficiency reasons. To this end, FIG. 5 shows an interior portion of a commercial fast food chain employing multiple back-to-back and even stacked microwave ovens 5, 5', 5", 5'" and 5"" constructed in accordance with the invention arranged on a work platform 100 behind a counter 105. As clearly shown, the compact nature of the ovens and the manner in which they can be intermeshed and stacked provides for an extremely efficient and effective overall ergonomic arrangement, with a minimum of occupied space yet providing for convenient access and still accommodating ventilation needs.

Although described with reference to a preferred embodiment of the invention, it should be readily understood that various changes and/or modifications can be made to the invention without departing from the spirit thereof. In general, the invention is only intended to be limited by the scope of the following claims.

We claim:

1. A microwave oven comprising:

an outer cabinet including a top panel having a raised peripheral edge, a first lateral side portion, a second lateral side portion and a back side portion, wherein the first lateral side portion has a greater fore-to-aft dimension than the second lateral side portion such that first lateral side portion defines an extension beyond the back side portion, with the extension including a rear portion defined by a first section substantially parallel to the back side portion and an angled section leading to the first lateral side portion of the outer cabinet;

an oven cavity provided within the outer cabinet;

a door attached to the outer cabinet for movement between an open position exposing the oven cavity and a closed position;

at least one vent provided in the outer cabinet at the angled section of the extension; and a plurality of feet extending below the outer cabinet for resting the oven on a support surface wherein, when first and second, similarly constructed ones of the microwave ovens are arranged back-to-back, the extension of the first one of the microwave ovens is arranged adjacent the second lateral side portion of the second one of the microwave ovens and the extension of the second one of the microwave ovens is arranged adjacent the second lateral side portion of the first one of the microwave ovens in order to provide a compact, jigsaw-type back-to-back interfitting arrangement with the angled section of each microwave oven providing spacing to accommodate cabinet ventilation and, when first and second, similarly constructed ones of the microwave ovens are stacked as upper and lower microwave ovens, the plurality of feet of the upper oven are arranged adjacent the raised peripheral edge of the lower microwave oven, thereby relatively locating the upper and lower microwave ovens in relation to each other.

2. The microwave oven according to claim 1, wherein each of the plurality of feet are vertically adjustable.

3. The microwave oven according to claim 1, further comprising: a control panel including a multi-segment display, a numeric keypad section, an entry button, a power level button, a start button and a stop button.

4. The microwave oven according to claim 1, wherein the oven cavity is in the order of 13 inches (33 cm) wide, 8 inches (20 era) deep and 6 inches (15 cm) in height.

5. The microwave oven according to claim 1, further comprising: venting louvers provided in a front wall portion of the outer cabinet wherein, when the door is in the open position, the door extends across and covers the venting louvers.

6. The microwave oven according to claim 5, wherein the door is vertically slidably mounted for movement relative to the outer cabinet between the open and closed positions.

7. A microwave oven comprising:

an outer cabinet including a top panel having a raised peripheral edge, a first lateral side portion, a second lateral side portion and a back side portion, wherein the first lateral side portion has a greater fore-to-aft dimension than the second lateral side portion such that first lateral side portion defines an extension beyond the back side portion, with the extension including a rear portion defined by a first section and an angled section;

an oven cavity provided within the outer cabinet;

a door attached to the outer cabinet for movement between an open position exposing the oven cavity and a closed position; and at least one vent provided in the outer cabinet at the angled section of the extension wherein, when first and second, similarly constructed ones of the microwave ovens are arranged back-to-back, the extension of the first one of the microwave ovens is arranged adjacent the second lateral side portion of the second one of the microwave ovens and the extension of the second one of the microwave ovens is arranged adjacent the second lateral side portion of the first one of the microwave ovens in order to provide a compact, jigsaw-type back-to-back interfitting arrangement with the angled section of each microwave oven providing spacing to accommodate cabinet ventilation.

8. The microwave oven according to claim 7, wherein the angled section leads to the first lateral side portion of the outer cabinet.

9. The microwave oven according to claim 7, further comprising: a control panel including a multi-segment display, a numeric keypad section, an entry button, a power level button, a start button and a stop button.

10. The microwave oven according to claim 7, wherein the oven cavity is in the order of 13 inches (33 cm) wide, 8 inches (20 cm) deep and 6 inches (15 cm) in height.

11. The microwave oven according to claim 7, further comprising: venting louvers provided in a front wall portion of the outer cabinet.

12. The microwave oven according to claim 11 wherein, when the door is in the open position, the door extends across and covers the venting louvers.

13. The microwave oven according to claim 12, wherein the door is vertically slidably mounted for movement relative to the outer cabinet between the open and closed positions.

14. A microwave oven comprising:

an outer cabinet including a top panel having a raised peripheral edge, a first lateral side portion, a second lateral side portion, a front wall portion and a back side portion;

an oven cavity provided within the outer cabinet;

venting louvers provided in the front wall portion of the outer cabinet;

a door attached to the outer cabinet for movement between an open position exposing the oven cavity and a closed position, wherein the door is vertically slidably mounted for movement relative to the outer cabinet between the open and closed positions; and a plurality of feet extending below the outer cabinet for resting the oven on a support surface wherein, when first and second, similarly constructed ones of the microwave ovens are stacked as upper and lower microwave ovens, the plurality of feet of the upper oven are arranged adjacent the raised peripheral edge of the lower microwave oven, thereby relatively locating the upper and lower microwave ovens in relation to each other and wherein, when the door of the lower microwave oven is placed in the open position, the door extends across and covers the venting louvers of the lower microwave oven while remaining below the upper microwave oven.

15. The microwave oven according to claim 14, wherein each of the plurality of feet are vertically adjustable.

16. The microwave oven according to claim 14, further comprising: a control panel including a multi-segment display, a numeric keypad section, an entry button, a power level button, a start button and a stop button.

17. The microwave oven according to claim 14, wherein the oven cavity is in the order of 13 inches (33 cm) wide, 8 inches (20 cm) deep and 6 inches (15 cm) in height.

* * * * *